United States Patent [19]

Mohler et al.

[11] Patent Number: 4,938,294

[45] Date of Patent: Jul. 3, 1990

[54] TRIGGER ELEMENT FOR A SPRINKLER

[76] Inventors: Johann G. Mohler, Bahnhofstrasse 11, Pratteln, Switzerland, CH-4133; Petr Bohac, Im Rüteli 21, Baden, Switzerland, CH-5405

[21] Appl. No.: 275,173

[22] PCT Filed: Feb. 11, 1988

[86] PCT No.: PCT/CH88/00033

§ 371 Date: Oct. 13, 1988

§ 102(e) Date: Oct. 13, 1988

[87] PCT Pub. No.: WO88/06046

PCT Pub. Date: Aug. 25, 1988

[30] Foreign Application Priority Data

Feb. 13, 1987 [CH] Switzerland ..... 535/87

[51] Int. Cl.[5] ..... A62C 37/14; A62C 37/32

[52] U.S. Cl. ..... 169/38; 169/37

[58] Field of Search ..... 169/37–41, 169/90, 91, DIG. 3

[56] References Cited

U.S. PATENT DOCUMENTS

| | | | |
|---|---|---|---|
| 1,771,826 | 7/1930 | Taylor | 169/38 |
| 1,905,676 | 4/1933 | Barclay | 169/38 |
| 2,125,510 | 8/1938 | Lewis | 169/38 |

FOREIGN PATENT DOCUMENTS

| | | | |
|---|---|---|---|
| 3220124 | 12/1983 | Fed. Rep. of Germany | 169/38 |
| 713683 | 10/1931 | France | 169/38 |
| 8806046 | 8/1988 | World Int. Prop. O. | 169/37 |

*Primary Examiner*—Joseph F. Peters, Jr.
*Assistant Examiner*—James M. Kannofsky
*Attorney, Agent, or Firm*—Wenderoth, Lind & Ponack

[57] ABSTRACT

The response time of the trigger elements of permanently installed glass barrel sprinkler installations can be shortened by the use of special expanding liquids having a low heat capacity coupled with rapid heat absorption. In particular, lower alkyl homologs of benzene such as, for example, toluene and o-xylene, or halogen derivatives of hydrocarbons such as, for example, tetrachloroethylene, are more suitable for this purpose than the hitherto used expanding liquids based on alcohols. However, aliphatic hydrocarbons of medium chain length, lower cycloaliphatic hydrocarbons, esters of ketocarboxylic acids and simple lower ketones can also be used. The fast response of the glass barrel sprinklers allows fires to be fought at an earlier stage and reduces the water requirement and hence the installation costs.

4 Claims, No Drawings

TRIGGER ELEMENT FOR A SPRINKLER

In the field of permanently installed fire-fighting equipment, thermally triggered sprinkler installations screwed to the water mains represent the most widely used extinguishing system. In the case of glass barrel sprinklers, the water outlet nozzle is closed by a small glass barrel filled with a suitable liquid. In the event of fire, the hot smoke gases effect heating of the expanding liquid; the latter expands and, when the triggering temperature pre-determined by the quantity of liquid filled in a barrel is reached, bursts the small glass barrel. As a result, the nozzle is automatically freed and sprays the seat of the fire with an extinguishing jet dispersed into droplets.

Even though the first automatic sprinkler extinguishing systems have been installed as early as in the last century, their development is not yet complete even now. In order to be able to fight a fire immediately after it has broken out, it is above all necessary still to shorten the response time of glass barrel sprinklers—that is to say the time required for heating the expanding liquid to the triggering temperature. Fast-response sprinkler installations provide improved protection of material property and, above all, also persons present in the room at risk. At the same time, the resulting decrease in effective area allows a reduction in the fire-fighting water required.

The nominal opening temperatures of the glass barrel sprinklers can easily be recognised by the color of the expanding liquid, which is obtained by the addition of suitable dyes. The color markings are given in Table I which follows:

TABLE I

| Nominal opening temperature (°C.) | Color |
|---|---|
| 57 | orange |
| 68 | red |
| 79 | yellow |
| 93 | green |
| 141 | blue |
| 182 | light violet |
| 204/260 | black |

Not only the heat capacity of the expanding liquid but also its thermal conductivity and viscosity play an important role in the response time of the glass barrel sprinklers. To ensure that the scatter of the triggering temperature is within the span of the narrowest possible tolerances of about 5%, the expanding liquid should in addition cause the steepest possible pressure rise on heating, that is to say it should have a high value of the ratio, which determines the pressure rise with temperature (dP/dT), of the co-efficient of thermal expansion to the compressibility (>10 bar/K). The response time can be influenced on the one hand by the important physical properties and on the other hand by constructional measures. A shortening of the response time results, for example, from reduction in the wall thickness of the small glass barrel, from an increase in the thermal conductivity of the glass material and/or the expanding liquid, in the same way as form a reduction in the capacity of the small glass barrel. For this purpose, German Offenlegungsschrift DE 3,220,124 A1 published on 1st Dec. 1983 describes a reduction in the filling volume of liquid by means of an inserted displacement body. At present, the expanding liquids used for glass barrel sprinklers are predominantly alcohols, namely n-butanol, isopropanol and glycerol, and less frequently also paraffin oil or most recently ethyl acetate.

The present invention shortens the response time by the use of special expanding liquids, with which the heat absorption takes place particularly rapidly, as the internal filling of the small sprinkler glass barrels. It has been found experimentally that the response time of the small glass barrels used as trigger elements depends, on the one hand, on the product of the mean heat capacity of the expanding liquid with its density and the volume of the glass barrel (heat capacity of the internal filling), but on the other hand also on the thermal conductivity of the expanding liquid and its viscosity. The co-efficient of thermal expansion, the toxicity and the chemical stability of a liquid in the course of time also play a role in its use as an expanding liquid.

The experimentally determined relative response times of some expanding liquids are shown in table II.

TABLE II

Relative response times of some expanding liquids

| Substance: | Boiling point | Relative response time (relative to water = 100) |
|---|---|---|
| Isopropanol | 82° C. | 114 |
| Water | 100° C. | 100 |
| KCl solution, 35.5% | | 86 |
| Ethanol | 80° C. | 75 |
| Methanol | 64° C. | 88 |
| Glycerol | 290° C. | 97 |
| Ethyl acetate | 76° C. | 65 |
| Toluene | 110° C. | 59 |
| n-Decane | 173° C. | 66 |
| Cyclohexane | 80° C. | 63 |
| Trichloroethylene | 86° C. | 62 |
| Tetrachloroethylene | 120° C. | 62 |
| Ethyl acetoacetate | 69° C. | 62 |
| Acetone | 56° C. | 60 |

Low values for the response times are obtained especially with toluene and some halogen derivatives of the hydrocarbons. By using these substances as expanding liquids, the response time of the glass barrel sprinklers can be reduced to half as compared with the hitherto used expanding liquids such as, for example, isopropanol. Their use therefore means an important step in the development of fast-response glass barrel sprinkler installations which, due to their fast response, extinguish a fire at an earlier stage.

In table III which follows, the volume-related heat capacities (i.e. the products of the heat capacity and the density), the viscosities, the thermal conductivities and the calculated values of the pressure rise with temperature (corresponding to the ratio of co-efficient of thermal expansion and compressibility) of some expanding liquids are shown.

TABLE III

Further properties of some expanding liquids

| Substance | C × D = C' (J/ml) | Viscosity (mPa × s) | Thermal conductivity (W/cm × K) | dP/dT (calculated) (bar/K) |
|---|---|---|---|---|
| Isopropanol | 1.955 | 2.43 | 0,0239 | 9.55 |
| Water | 4.186 | 1.00 | | 13.9* |

TABLE III-continued

| Further properties of some expanding liquids | | | | |
|---|---|---|---|---|
| Substance | C × D = C' (J/ml) | Viscosity (mPa × s) | Thermal conductivity (W/cm × K) | dP/dT (calculated) (bar/K) |
| Ethanol | 1.921 | 1.20 | 0.0289 | 9.1 |
| Methanol | 1.988 | 0.60 | 0.0352 | 9.08 |
| Glycerol | 2.955 | 830 | 0.0498 | 15.26 |
| Ethyl acetate | | | | 12.0 |
| Toluene | 1.473 | 0.59 | 0.0239 | 11.32 |
| Cyclohexane | | | | 9.30 |
| Trichloroethylene | 1.344 | | | |
| Tetrachloroethylene | 1.423 | | | |
| Acetone | 1.674 | 0.31 | | 10.47 |

C × D = C' = Product of heat capacity and density = volume-related heat capacity
dP/dT = Pressure rise with temperature; response to the ratio of the co-efficient of thermal expansion and compressibility
*Mean of the values In general, it is advantageous, if the volume-related heat capacity C' has a value <1.5 J/ml, the viscosity has a value<0.8 mPaxs, the thermal conductivity has a value>0.025 W/cm×K. and the pressure rise with temperature dP/dT has, as mentioned above, a value >10 bar/K. However, poorer values for one or more properties and better values for other properties can balance out to a certain extent.

The invention thus relates to a trigger element for a sprinkler, the water outlet nozzle of the sprinkler being kept closed by a trigger element consisting of a small glass barrel and filled with an expanding liquid, wherein the expanding liquid is selected from the group comprising lower alkyl homologs of benzene, aliphatic hydrocarbons of medium chain length, lower cycloaliphatic hydrocarbons, halogenated hydrocarbons, esters of ketocarboxylic acids, and simple lower ketones and mixtures of these with one another or with other liquids miscible with these.

The lower alkyl homologs of benzene, the aliphatic hydrocarbons of medium chain length, that is to say e.g. aliphatic hyrocarbons having 5–12 carbon atoms, the lower cylcoaliphatic hydrocarbons, that is to say e.g. cycloaliphatic hydrocarbons having up to 8 carbon atoms, the halogenated hydrocarbons, the esters of ketocarboxylic acids and the simple lower ketones can be mixed with one another and with other liquids, as a rule with organic compounds known as expanding liquids, such as lower monohydric or polyhydric aliphatic alcohols and lower alkyl esters of lower alkanecarboxylic acids, in any proportions in which they are miscible with one another.

For example, the expanding liquid can consist of toluene, xylene, n-decane, cyclohexane, trichloroethylene, tetrachloroethylene, ethyl acetoacetate, acetone or methyl ethyl ketone or mixtures thereof. Depending on their boiling point, the expanding liquids can be used for different nominal opening temperatures. For example, in spite of its relatively long response time, n-decane is suitable for nominal opening temperatures up to 182° C.

In addition to the abovementioned specific compounds, the expanding liquid can also contain, for example, methanol, ethanol, isopropanol, glycerol or ethyl acetate or mixtures thereof as the lower monohydric or polyhydric aliphatic alcohol or lower alkyl ester of a lower alkanecarboxylic acid or a mixture thereof, but no special advantages can as a rule be obtained thereby.

What is claimed is:

1. A trigger element for a sprinkler, the sprinkler having a water outlet nozzle, the water outlet nozzle of the sprinkler being kept closed by the trigger element, wherein the trigger element consists essentially of a small glass barrel filled with an expanding liquid selected from the group consisting of toluene, a xylene, trichloroethylene, tetrachloroethylene and a mixture thereof.

2. A trigger element as claimed in claim 1, wherein the expanding liquid also contains a member selected from the group consisting of a lower monohydric aliphatic alcohol, a lower polyhydric aliphatic alcohol, a lower alkyl ester of a lower alkanecarboxylic acid, and a mixture thereof.

3. A trigger element as claimed in claim 1 or 2, wherein the expanding liquid comprises a member selected from the group consisting of toluene and a xylene.

4. A trigger element as claimed in claim 1 or 2, wherein the expanding liquid comprises a member selected from the group consisting of trichloroethylene and tetrachloroethylene.

* * * * *